United States Patent [19]

Kurz

[11] Patent Number: 4,481,692

[45] Date of Patent: Nov. 13, 1984

[54] OPERATING-CONDITION INDICATOR FOR VACUUM CLEANERS

[76] Inventor: Gerhard Kurz, Industriestrasse, 7261 Althengstett, Fed. Rep. of Germany

[21] Appl. No.: 485,286

[22] Filed: Apr. 15, 1983

[30] Foreign Application Priority Data

Mar. 29, 1983 [DE] Fed. Rep. of Germany ..... 3311380

[51] Int. Cl.[3] ..... A47L 9/19

[52] U.S. Cl. ..... 15/339; 55/274; 116/268

[58] Field of Search ..... 15/339; 116/268; 55/274

[56] References Cited

U.S. PATENT DOCUMENTS

| | | | |
|---|---|---|---|
| 3,172,743 | 3/1965 | Kowalewski | 15/339 X |
| 3,177,635 | 4/1965 | Cawl et al. | 15/339 X |
| 4,199,838 | 4/1980 | Simonsson | 55/274 X |

*Primary Examiner*—Chris K. Moore

*Attorney, Agent, or Firm*—McAulay, Fields, Fisher, Goldstein & Nissen

[57] ABSTRACT

An operating condition indicator for vacuum cleaners which has a diaphragm switch which responds to vacuum and a luminous indicating device. The operating-condition indicator is intended for vacuum cleaners which have a turboblower which acts directly on the suction connection and is arranged in front of the dust bag, the pressure detected in the region of the suction opening becoming less as the dust bag becomes increasingly full. The vacuum is detected at the suction opening and fed to a diaphragm switch having additional spring biasing, as a result of which an indication of readiness for operation is obtained when the motor is off and, in addition, a warning indication is given when the dust bag is excessively full, without the necessity of actuating a switch.

4 Claims, 2 Drawing Figures

OPERATING-CONDITION INDICATOR FOR VACUUM CLEANERS

DESCRIPTION OF THE PRIOR ART

The invention refers to an operating-condition indicator for vacuum cleaners and more particularly to an operating condition indicator for vacuum cleaners having a diaphragm switch which responds to a vacuum.

From West German Pat. No. 27 12 201 a device for indicating a condition resulting from a change in pressure is known which, as vacuum or pressure switch, is intended to indicate the extent to which the dust bag of household or industrial vacuum cleaners is full. The indicating device comprises a diaphragm which, via a spring-loaded push pin, acts in such a manner on two switch-forming contact elements for the making of electric contact that when given values of vacuum are reached an electric luminous indicator is turned on. A common housing is provided which is closed at its front by a diaphragm. On the side of the housing facing away from the diaphragm there is located the luminous region which directly indicates the corresponding change in the state of the pressure. The known indicating device can be adjusted very accurately to a specific threshold pressure for response, adjustment being furthermore possible from the luminous region of the device. The known device, however, can be used only to indicate the extent to which the dust bag is full and it is suitable furthermore only for vacuum cleaners in which the fan driven by an electric motor is located behind the dust bag proper, in other words in those systems in which the vacuum produced by the blower becomes constantly stronger as the dust bag of the vacuum cleaner becomes fuller.

On the other hand, there is a need for a more extensive indication of operating condition in those vacuum cleaners which have a turboblower which acts directly on the suction opening or suction hose of the vacuum cleaner and in which the dust bag is located behind the blower, customarily developed as a turbine wheel, so that as the dust bag becomes fuller the vacuum effects produced by the turbine become less since the turbine is operating against increasing pressure resistance.

ADVANTAGES OF THE INVENTION

Accordingly an object of the present invention is the provision of a vacuum cleaner operating-condition indicator capable of displaying an indication of readiness for operation which indication is done away with upon commencement of the ordinary operation as vacuum cleaner of a vacuum cleaner driven by a turboblower but then lights up again when the vacuum cleaner, which is arranged behind the turbine, reaches a predetermined threshold value of extent of filling, i.e. when the dust bag means becomes so clogged by the particles of dirt and dust drawn in that the turboblower can no longer breathe sufficiently freely and therefore also no longer produces a sufficient vacuum. In such vacuum cleaners, the suction action is furthermore particularly strong and effective in the case of a correspondingly free dust bag with good suction effect, since the turbine wheel acts directly on the suction hose. In this case, however, it is necessary to tolerate the fact that the parts drawn in must also pass through the turbine wheel of the blower before they enter the dust bag.

Another object is the provision of such an indicator wherein the assembling and mounting of the operating-condition indicator of the invention is uncomplicated and inexpensive, as is its adjustment.

Another object of the invention is the provision of such an indicator, which makes possible the making of electric contacting by response to the prevailing vacuum in such a manner that, when the vacuum cleaner is not operating, contact is made and a corresponding luminous indication obtained, which is extinguished only by the vacuum produced, upon operation of a vacuum cleaner, against the action of the second biasing spring until the vacuum again becomes so slight due to the gradual filling of the dust bag - in each case with detection of the vacuum at the narrowing transition region between vacuum-cleaner turbine wheel and vacuum hose connection - that the diaphragm can no longer maintain the distance from the contact spring and is pressed against it by the second biasing spring. A luminous indication is then again given, this time with the blower operating, as a result of which the user knows that the dust bag must now be emptied since the vacuum which is still being produced by such type of vacuum cleaner is no longer sufficient for satisfactory vacuum cleaning. Another object is the provision of such an indicator which the vacuum diaphragm switch and the luminous indicator can be mounted and integrated in a common housing, so that the diaphragm switch, together with its housing, can be so inserted into the housing of the vacuum cleaner that the luminous indicator is freely accessible from the outside for visual noting of the condition of switching and possibly adjustment and the diaphragm-switch region extends into the vacuum-cleaner housing.

DRAWING

One embodiment of the invention is shown, by way of example, in the drawing and will be explained in further detail in the following description.

FIG. 1 shows, very diagrammatically, a vacuum cleaner with front turboblower, followed by a dust bag, and FIG. 2 shows one possible embodiment of a diaphragm switch used for indication of the condition of operation, which responds to the vacuum in the region of the pipe connection.

DESCRIPTION OF THE EMBODIMENTS

Figure 1:
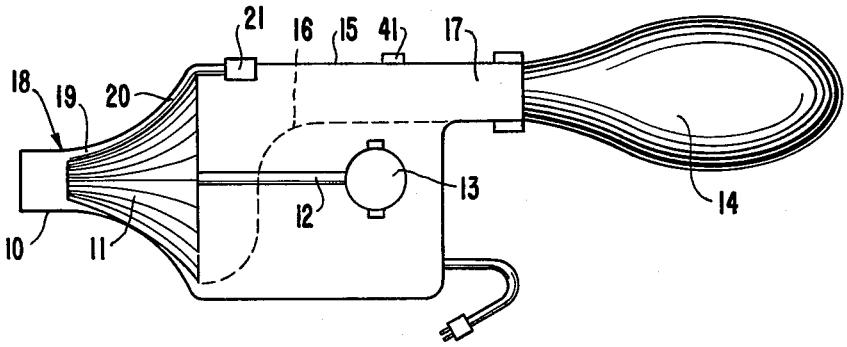

The vacuum cleaner shown in FIG. 1 is a vacuum cleaner with turbine wheel 11 at the front, i.e., operating directly on the suction-hose connection 10, the wheel being driven via a suitable shaft 12 by an electric motor of any desired construction, indicated at 13. The vacuum effect produced in the opening of the suction-hose connection 10, produced by the turbine wheel 11 which rotates at high speed, is particularly strong; the particles of dirt and other parts drawn in there (via the connected suction hose with brush) pass through the turboblower 11 into a rear dust bag 14, all parts being surrounded by a suitable vacuum-cleaner housing 15 and being mounted in or on it. As is obvious, a partition, indicated merely in dashed line at 16, is provided which, behind the turboblower 11, takes up the quantities of air drawn in and conducts them, via the narrowed air outlet region at 17, into the dust bag 14, the motor 13 customarily not lying within the air flow of the blower so that it can also not be damaged by the entrained particles of dirt; its drive shaft passes in suitable manner through this partition or dividing wall; these statements, which do not concern the object of the present invention, are intended for a better understanding of the invention which will be described below.

Such a type of vacuum cleaner makes it possible, namely, for an operating-condition indicator which is controlled by a vacuum diaphragm to be lit by a corresponding electric contacting both when the vacuum cleaner is in its condition of readiness for operation and when the extent of fullness of the dust bag exceeds a predetermined threshold value, at which time emptying should take place. The reason for this is that, with the motor and blower stopped, but with the power cord plugged in, no vacuum is (of course) produced by the turbine wheel 11, the detection of this vacuum taking place preferably in the region designated 18 and therefore at the place where the turbine wheel 11 narrows down and passes into the suction connection 10 to which the suction hose (not shown) is connected. At this place, the strongest vacuum action is produced and to this place there is then also brought one end 19 of a vacuum transfer hose 20 which then conveys the vacuum taken up by it to a diaphragm switch 21 which is mounted at a suitable point and also forms the indicating light. The transfer of the vacuum via the hose 20 to the point of attachment of the indicating diaphragm switch is logical since there is no room for the diaphragm switch at the actual point of detection of the vacuum.

Figure 2:
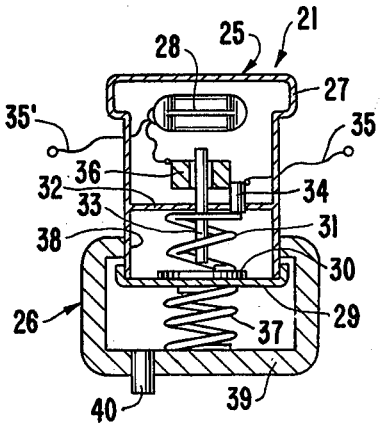

A preferred embodiment of an integrated diaphragm switch is shown in FIG. 2; it has a luminous region 25 as well as a diaphgram region 26 which responds to the variations or action of the vacuum; a common housing 27 is provided which, at the top, forms the luminous region containing a lamp 28—this lamp may also be a light-emitting diode or an incandescent bulb—and at the bottom bears the actual diaphragm 29, for instance on an end flange of the housing. The diaphragm has an electrically conductive contact plate 30 and in the manner shown in the drawing is urged downward by a first biasing spring 31 which is itself electrically conductive and rests in electrically conductive manner against the diaphragm plate 30 so that an electrical contact pin 33 mounted, for instance, in a central partition wall 32 of the housing is located at a predetermined distance from the diaphragm-driven contact plate 30. An electric contact pin 34 is connected to the lower first biasing spring 31, which here also rests against the housing partition 32, the contact pin being connected via a solder lug to a first electric feed wire 35.

For adjustment, the contact pin 33 can be supported for vertical displacement in a metallic, and therefore electrically conductive, internally threaded sleeve 36, the sleeve then forming the second electric terminal, which is connected via the indicating lamp to the other outside terminal 35'.

It can be seen that upon the action of a suitable vacuum, pressure or pressure difference, movement of the diaphragm can be obtained until the contact plate 30 makes a conductive connection with the contact pin 33, due to which, upon the application of a voltage to the terminals 35, 35' the light will light up when given threshold pressures are reached.

In the preferred embodiment shown in FIG. 2, another biasing spring 37 acts on the diaphragm 29, this spring resting against a closure wall 39 of pot-shaped development which is connected, for instance clamped fast, at 38 to the housing 27. The transition region between the housing wall 39 and the diaphragm switch housing 37 (sic) is airtight and a vacuum connection nipple 40 is provided via which the vacuum detected at 19 is conducted by the vacuum transfer hose 20 to the diaphragm 29.

The following manner of operation then results:

The biasing springs 31 and 37 are so dimensioned that when no vacuum is acting, the biasing spring 37 in any event produces contact between the contact plate 30 and the contact pin 33, so that when the drive motor for the turboblower 11 is stopped but the power cord is connected, an indication of readiness for operation is given by the lighting-up of the lamp 28.

As soon as the turboblower then starts as a result of turning on of the motor by a push button fastened, for instance, at 41 to the vacuum cleaner housing 15, the vacuum which develops causes the diaphragm to move away from its position of contact with the contact pin 33, so that the indication of readiness for operation goes out and the vacuum cleaner can be operated as customary.

If the dust bag then becomes gradually clogged, the vacuum developed in such case at 19 by the turboblower will then not become stronger but rather weaker, and as a matter of fact considerably weaker, since the turboblower is operating practically against a constantly increasing resistance which increases to an infinite value.

As from a given degree of fullness of the dust bag, the vacuum produced by the turboblower can then no longer hold the diaphragm and an indication is again given by the lighting-up of the lamp 28. It is clear that this vacuum threshold value can be set, and the embodiment of the vacuum diaphragm switch of FIG. 2 according to the invention permits particularly sensitive adjustment of the vacuum threshold value by the possibility of adjusting the contact pin 33 by turning it upward or downward in its fine thread within the sleeve 36 and of thus adjusting its distance from the contact plate 30. The adjustment can also be effected with the diaphragm switch installed by removing the cover in the region of the light.

It is obvious that the indicating light can, of course, also be arranged at some place other than the diaphragm switch, in such case dispensing with the common housing with it.

What is claimed is:

1. A device for indicating the condition of a vacuum cleaner of the type having a diaphragm switch which responds to a vacuum, an indicating member, a dust bag, a motor-driven turboblower positioned in front of said dust bag, connecting means for connecting the cleaner with a source of energy, a suction hose connection with an opening formed therein, said turboblower operating on said suction hose connection, and a constricted region of transition located between said turboblower and said suction hose connection; said device comprising: conduit means connecting the region of transition with said switch whereby said diaphragm moves in a first direction in response to a vacuum, electric contact means associated with said diaphragm and adapted to be connected together when said diaphragm is in a first position and to be disconnected when said diaphragm moves in said first direction, biasing means for biasing said diaphragm to said first position in response to a vacuum below a preselected value corresponding to the filling of the dust bag to a preselected amount, and lead means connecting said electric contact means in circuit with said indicator means and said connecting means, whereby said indicator is illuminated in response to connection of said connecting means to a source of energy and in the absence of vacuum to indicate readiness of the vacuum cleaner for operation and in response to the filling of the dust bag to said preselected amount.

2. The device of claim 1 and additionally comprising a housing; and wherein the diaphragm switch and the luminous indicating member are mounted on said housing.

3. The device of claim 1 wherein said biasing means includes an electrically conductive first biasing spring and a second biasing spring, said first and second springs located on opposite sides of said diaphragm and wherein said contact means includes a contact plate abutting said first spring and being movable with said diaphragm and a threaded contact pin with an associated sleeve, said pin located at an adjustable distance from said contact plate, said distance adjusted by turning said threaded pin in said associated sleeve, said contact plate being electrically connected to said connecting means through said first spring, said associated sleeve being electrically conductive and electrically connected to both said luminous indicating member and to said connecting means.

4. A device as in claim 3 and additionally comprising a pot-shaped closure wall connected to said housing such that said transition region is air tight, and wherein said second biasing spring abuts said diaphragm at one end and said closure wall at the other end.

* * * * *